US005269621A

United States Patent [19]

De Bortoli et al.

[11] Patent Number: 5,269,621

[45] Date of Patent: Dec. 14, 1993

[54] FASTENING DEVICE PARTICULARLY FOR FINE ADJUSTMENT OF THE TENSION APPLICABLE BY MEANS OF A LEVER

[75] Inventors: Giuseppe De Bortoli, Montebelluna; Luca Gallina, Caerano S. Marco; Claudio Zorzi, Paderno Di Ponzano, all of Italy

[73] Assignee: Nordica S.p.A., Montebelluna, Italy

[21] Appl. No.: 917,248

[22] Filed: Jul. 22, 1992

[30] Foreign Application Priority Data

Aug. 2, 1991 [IT] Italy ..... 000722/91[U]

[51] Int. Cl.[5] ..... B25G 3/28

[52] U.S. Cl. ..... 403/353; 403/21; 403/22; 36/50.5; 24/685 K

[58] Field of Search ..... 403/21, 22, 353, 43, 403/44, 45, 46, 47; 24/685 K, 68 A, 695 K, 498; 36/50.5

[56] References Cited

U.S. PATENT DOCUMENTS 1,065,408 6/1913 Thorsby ..... 403/44
1,418,298 6/1922 Gorman ..... 403/46
1,581,109 10/1923 Franke ..... 403/46
3,545,103 12/1970 Bloomfield et al. .

FOREIGN PATENT DOCUMENTS 479860 1/1952 Canada ..... 403/44
1355493 2/1964 France .
2534117 4/1984 France .
2582486 12/1986 France .
2010377 6/1979 United Kingdom .

*Primary Examiner*—Randolph A. Reese
*Assistant Examiner*—George D. Spisich
*Attorney, Agent, or Firm*—Guido Modiano; Albert Josif

[57] ABSTRACT

A fastening device particularly usable to obtain the fine adjustment of the tension applicable by a lever, for example to secure the flaps of a shell or a quarter of a ski boot. The device includes, on the tie rod member of the lever, a seat for a nut which in turn interacts with a threaded pin element for coupling to an engagement hook which is associable with one of the flaps to be closed of the boot. The device has very small dimensions, weight and cost together with simple assembly of the various components.

4 Claims, 2 Drawing Sheets

FASTENING DEVICE PARTICULARLY FOR FINE ADJUSTMENT OF THE TENSION APPLICABLE BY MEANS OF A LEVER

BACKGROUND OF THE INVENTION

The present invention relates to a fastening device particularly usable for fine adjustment of the tension applicable by means of a lever.

Levers are currently known which are constituted by a partially hollow body at which the stem of a T-shaped tie rod member is freely pivoted.

A seat for a nut, or threaded block, is also formed at the head of the tie rod member, which protrudes to the rear of the body of the lever; a complementarily threaded pivot is associated at said nut or block and is in turn connected to a grip means which is rigidly associated with a flap of the shell or of the quarter of a ski boot.

The problem of this known lever systems consists of the fact that the tie rod member has a considerable size and consequently a high weight and manufacturing cost.

SUMMARY OF THE INVENTION

The aim of the present invention is to eliminate the problems described above in known types by providing a device which allows to achieve a fine adjustment of the tension applicable by means of a lever, by using components which can be easily assembled.

Within the scope of the above aim, another important object is to provide a device wherein it is possible to achieve said fine adjustment in a very small space.

Another important object is to provide a device wherein it is possible to reduce the number of components with respect to the known art.

Another important object is to provide a device which allows an optimum and rapid assembly of the various components.

Another object is to provide a device which associates with the preceding characteristics that of being reliable and safe in use and has very low manufacturing costs.

This aim, these objects and others which will become apparent hereinafter are achieved by a fastening device particularly for fine adjustment of the tension applicable by means of a lever, characterized in that said lever has a tie rod member having at least one seat formed therein, said seat having temporary connection means for at least one nut which interacts with an element for coupling to an engagement means.

BRIEF DESCRIPTION OF THE DRAWINGS

Further characteristics and advantages of the invention will become apparent from the detailed description of a particular embodiment, illustrated only by way of nonlimitative example in the accompanying drawings, wherein.

DESCRIPTION OF THE PREFERRED EMBODIMENTS

Figure 1:
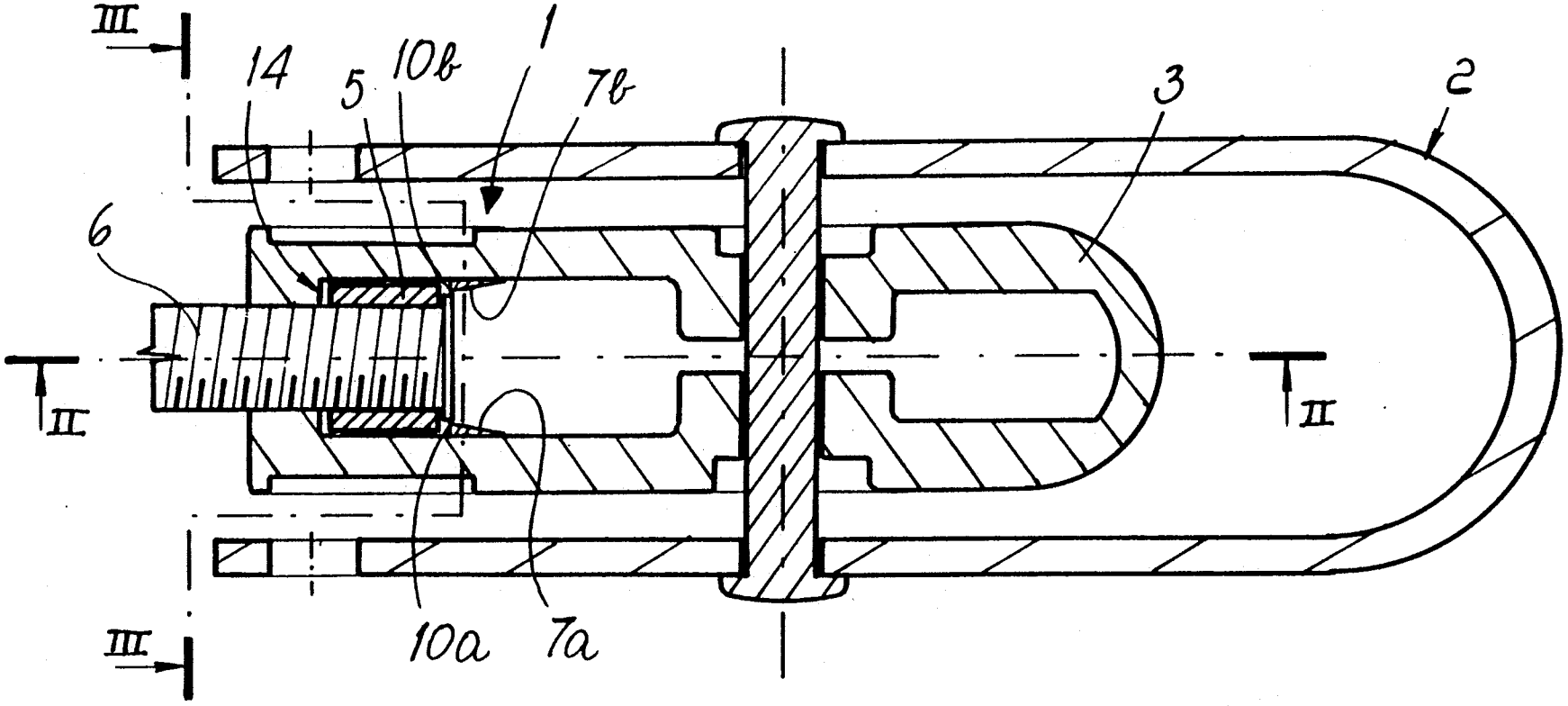
FIG. 1 is a sectional view of the device, taken along a longitudinal median plane.
Figure 3:
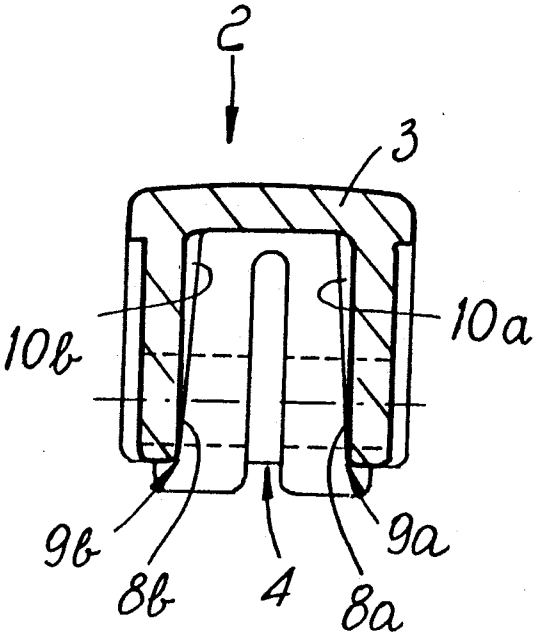
FIG. 3 is a sectional view, taken along the plane III—III of FIG. 1.

With reference to the above figures, the reference numeral 1 designates the fastening device which can be used particularly to achieve the fine adjustment of the tension which can be applied by means of a lever 2.

Said lever is constituted by a case-shaped tie rod member 3 having a substantially C-shaped transverse crosssection. At least one seat 4 is provided at said tie rod member 3 for a nut or block 5 which can be removably arranged thereat.

Said nut or block has a threaded hole which acts as a seat for a coupling element, such as a complementarily threaded pin 6. Said pin 6 is associated, at one end, with an engagement means, such as for example a metallic ring, which is in turn rigidly associated for example at an adapted rack. The rack is associated with one of the flaps of a shell or quarter of a ski boot or of another item of sports footgear.

The device comprises means for the temporary connection of said nut at said seat 4; said means are constituted by a pair of inclined planes, designated by the numerals **7*a* and 7*b***.

Said planes protrude from the inner lateral surfaces of the wings **8*a* and 8*b* of the seat 4 defined on the tie rod member 3 of the lever 2; said inclined planes have a substantially triangular configuration, with apexes 9*a* and 9*b* directed toward the free ends of the inner lateral surfaces of the wings 8*a* and 8*b* of the tie rod member 2, and an abutment planar surface 10*a* and 10*b* is defined by each protruding plane which is directed toward said nut 5**.

The inclination of said inclined planes **7*a* and 7*b*, by protruding from the inner lateral surfaces of the wings 8*a* and 8*b* of the tie rod member, thus allows to achieve an optimum retention of the nut 5** in its seat, preventing its escape.

Figure 2:
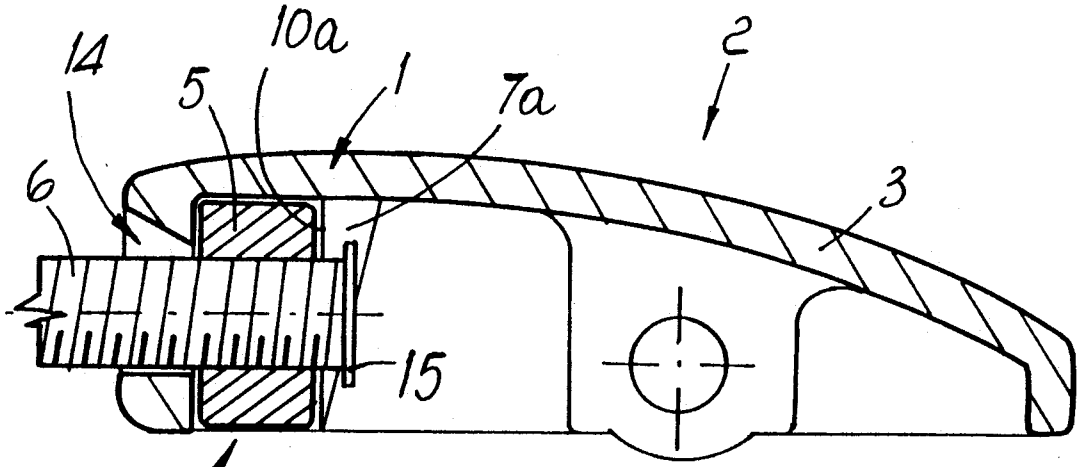
FIG. 2 is a sectional view, taken along the plane II—II of FIG. 1.
Figure 4:
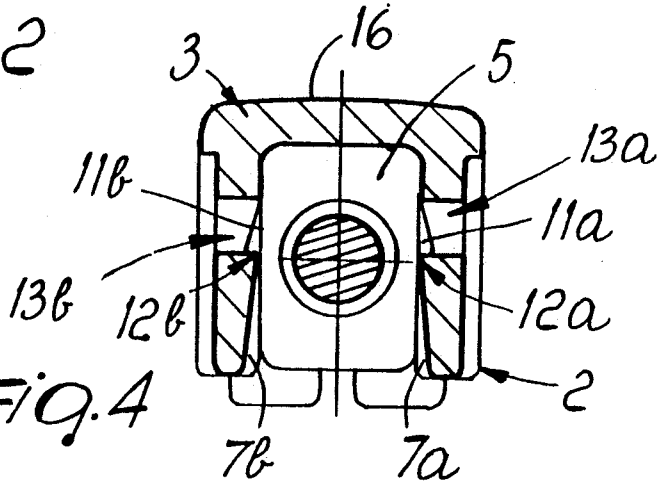
FIG. 4 is a view, similar to FIG. 3, of a further embodiment.

The nut 5 can be inserted in the seat 4 very easily by simply screwing the pin 6 to the nut 5, and subsequently inserting said pin 6 within the hole 14 defined to the rear of the tie rod member 3. The assembly thus formed is pushed into the seat 4, achieving snap-together locking by means of a slight deformation of the inclined planes **7*a* and 7*b* during insertion of the nut 5, after which the planes 7*a* and 7*b* return to their original shape once the nut 5 is fully inserted, and the abutment surfaces 10*a* and 10*b* thus retain the nut in place as seen in FIGS. 1 and 2**.

An annular flange 15 is provided at the end of the pin 6 in order to avoid the extraction of said pin 6 from the nut 5.

It has thus been observed that the invention has achieved the intended aim and objects, a device having been provided which is very simple in the assembly of the various components of the lever while considerably reducing volume occupation.

The device furthermore allows to achieve the fine adjustment of the tension which can be applied by means of the lever in very small spaces, and the various components can furthermore be assembled rapidly and easily at the lever body.

The device furthermore has very modest costs despite ensuring optimum operation for the lever.

As an alternative to what has been described, it is possible to provide inclined planes **11*a* and 11*b* which are defined on opposite surfaces of the nut 5 and are such as to define a step, designated by the numerals 12*a* and 12*b*, for temporary engagement at adapted seats 13*a*** and 13*b* defined at the lateral surfaces of the wings 8*a* and 8*b* of the tie rod member 3.

The coupling between said tie rod member and the nut 5 occurs in a snap-together manner, in this case as well.

Advantageously, additional inclined planes 7*a* and 7*b* are provided proximate to the free ends of said wings, protrude therefrom toward the nut 5 and have their apex directed toward the base 16 which connects said wings; the inclined planes 7*a* and 7*b* allow better insertion and locking of said nut.

The materials and the dimensions which constitute the individual components of the invention may naturally be the most pertinent according to the specific requirements.

We claim:

1. A fastening device comprising:

a pivoting lever element;

a tie rod member pivotally connected to said lever element, the tie rod member comprising a base and a pair of side wings extending from said base, a seat of said tie rod member being defined by said base and said pair of side wings;

a nut element accommodated in said seat of said tie rod member; and a threaded pin extending through a hole of said tie rod member and being screwed in said nut element;

wherein said tie rod member further comprises:

a pair of inclined planes defined inwardly on said side wings for facilitating the positioning of said nut element into said seat; and abutment surface means provided on said side wings for locking said nut element into said seat.

2. The fastening device of claim 1, wherein each one of said pair of inclined planes has a triangular configuration with an apex directed away from said base of said tie rod member, said each one of said pair of inclined planes protruding inwardly from said side wings starting from said apex thereof and extending up to said base, said abutment surface means being defined by said inwardly protruding inclined planes and being a pair of triangular planar surfaces sharing said apex and a common side with a respective one of said pair of inclined planes.

3. The fastening device of claim 1, wherein a pair of opposite seats are provided in said side wings of said tie rod member, said pair of opposite seats defining a pair of abutment steps which constitute said abutment surface means, said pair of inclined plane surfaces extending below said pair of opposite seats away from said base and being inclined such that they mutually converge in a direction towards said base, said nut element comprising a pair of protruding inclined plane surfaces being accommodated in said opposite seats.

4. The fastening device of claim 1, wherein an annular flange is provided at an end of said threaded rod for preventing said threaded rod from being unscrewed from said nut element.

* * * * *